US006536761B2

(12) United States Patent
Mochizuki et al.

(10) Patent No.: US 6,536,761 B2
(45) Date of Patent: Mar. 25, 2003

(54) PAPER MONEY HANDLING DEVICE

(75) Inventors: Akira Mochizuki, Mito (JP); Goro Sato, Chiyoda (JP); Riichi Katou, Nagoya (JP)

(73) Assignee: Hitachi, Ltd., Tokyo (JP)

( * ) Notice: Subject to any disclaimer, the term of this patent is extended or adjusted under 35 U.S.C. 154(b) by 50 days.

(21) Appl. No.: 09/826,870

(22) Filed: Apr. 6, 2001

(65) Prior Publication Data

US 2001/0052667 A1 Dec. 20, 2001

(30) Foreign Application Priority Data

Jun. 20, 2000 (JP) ..... 2000-189716

(51) Int. Cl.[7] ..... B65H 31/00

(52) U.S. Cl. ..... 271/208; 271/188; 902/14; 902/15

(58) Field of Search ..... 271/208, 188; 902/14, 15

(56) References Cited

U.S. PATENT DOCUMENTS 4,350,332 A * 9/1982 Knight ..... 271/188
4,501,418 A * 2/1985 Ariga et al. ..... 271/186
4,629,382 A * 12/1986 Ueshin ..... 209/534
5,037,581 A * 8/1991 Saitoh et al. ..... 252/500
5,342,165 A * 8/1994 Graef et al. ..... 271/12
5,581,289 A * 12/1996 Firl et al. ..... 271/9.09
5,740,006 A * 4/1998 Larkin ..... 361/213
5,843,567 A * 12/1998 Swift et al. ..... 174/110 R
6,152,445 A * 11/2000 Hirota et al. ..... 271/185

FOREIGN PATENT DOCUMENTS

JP 403264458 A * 11/1991

OTHER PUBLICATIONS

Japanese Patent Unexamined Publication No. 2–175558.
Japanese Patent Unexamined Publication No.11–180611.

* cited by examiner

*Primary Examiner*—Christopher P. Ellis
*Assistant Examiner*—Richard Ridley
(74) *Attorney, Agent, or Firm*—Antonelli, Terry, Stout & Kraus, LLP

(57) ABSTRACT

In order to eliminate charge on an outplane deformed paper money, a paper money handling device includes a paper money storing box for storing a conveyed paper money in the paper handling device, which has a storing mechanism for storing the paper money inside, and a storing guide provided on the storing mechanism has at least a flat part and a concavo-convex part, and a concave portion thereof includes a static eliminating part.

7 Claims, 11 Drawing Sheets

PAPER MONEY HANDLING DEVICE

BACKGROUND OF THE INVENTION

The present invention relates to a paper money handling device, and more particularly to reducing disadvantage caused by a statically charged paper money.

A paper sheet handling device disclosed in Japanese Unexamined Patent Publication No. 2-175558 is provided with a conductive member for an electric contact with a guide member and avoids charging of the guide member since a charged guide member draws a paper sheet during stacking thereof nipped by rollers in a primary stacking box.

A In the prior art disclosed in Japanese Unexamined Patent Publication No. 11-180611, the paper sheet is conveyed by a guide comprising a rib for guiding the paper sheet in a conveying direction and a static eliminating layer in order to avoid charging of the paper sheet.

SUMMARY OF THE INVENTION

However, the prior art disclosed in Japanese Unexamined Patent Publication No. 2-175558 has no reference to eliminating charge on a surface of the paper sheet.

The charge on the surface of the paper money is generated due to the fact that the paper money is charged by friction with the above described guide or a belt. The amount of the charge is on the order of some ten nC, which is not very large, so that the charge is difficult to transfer even if contacted with a grounded guide and that at most an effect of not being charged by friction can be obtained.

For this reason, studies have been conventionally made in respect of concentration of the charge for elimination thereof. For example, by a linear brush made of metal or plastic situated at its tip near the surface of the paper money, the charge is concentrated on the tip and electric discharge occurs to eliminate the charge.

The prior art disclosed in Japanese Unexamined Patent Publication No. 2-175558 has no reference to such concentration of the charge and electric discharge.

Further, the prior art disclosed in Japanese Unexamined Patent Publication No. 11-180611 has no reference to a jam between a static eliminating layer and the paper in the case where the paper is conveyed in an outplane deformed condition.

An object of the present invention is to provide a paper money handling device for handling the paper money with wrinkles, folds or breaks, which reduces disadvantage caused by the charged paper money.

In order to achieve the above described object, the paper money handling device according to the present invention includes a paper money storing box for storing the paper money conveyed in the device, which has a storing mechanism for storing the paper money inside, a storing guide provided on the storing mechanism has at least a flat part and a concavo-convex part, and a concave portion thereof includes a static eliminating part.

DESCRIPTION OF THE PREFERRED EMBODIMENTS

Figure 1:
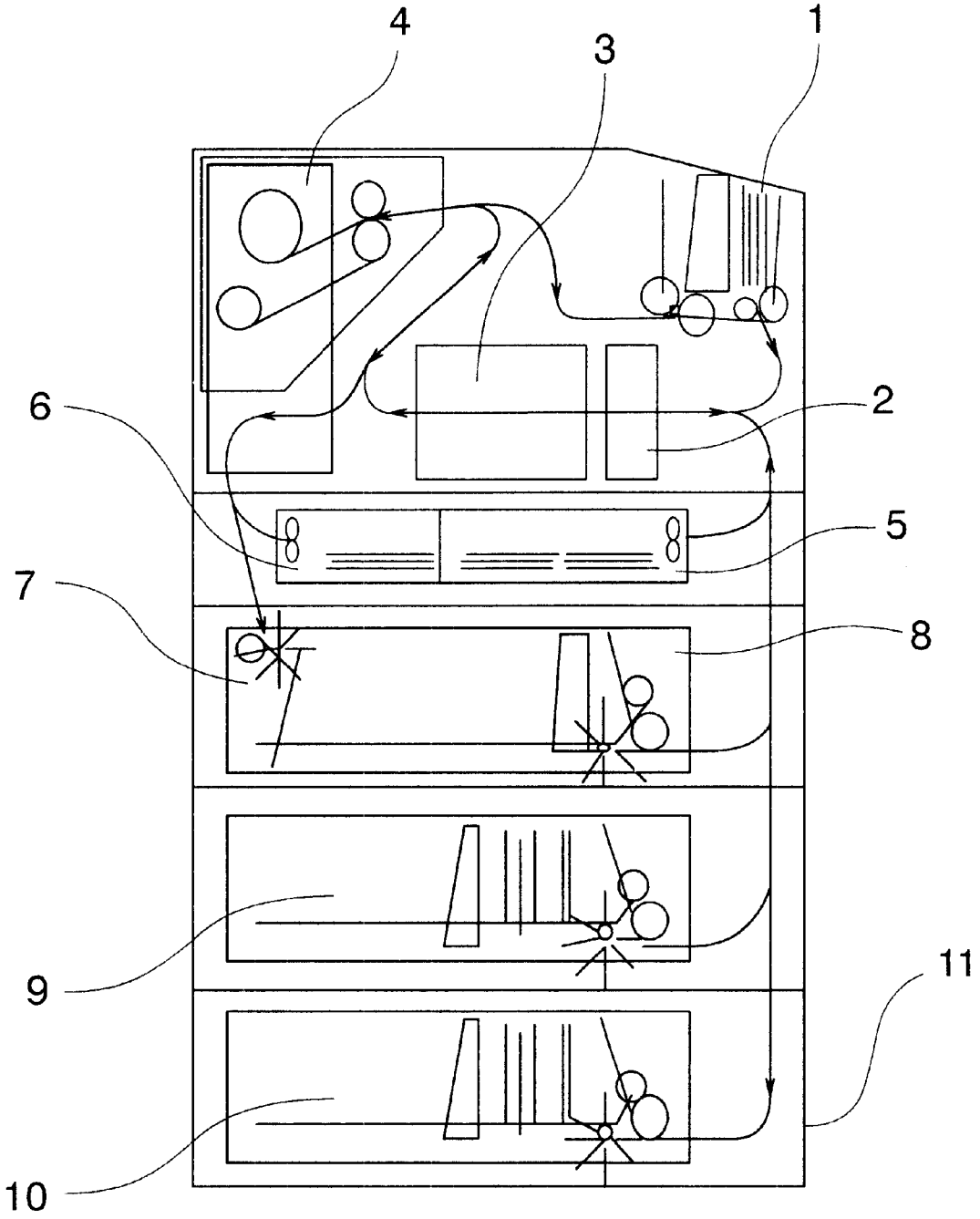
FIG. 1 is an explanatory view of a paper money handling device according to an embodiment of the present invention.

An embodiment of the present invention will be described below with reference to FIG. 1. FIG. 1 shows a paper money handling device 11 to which the present invention is applied.

The paper money handling device 11 comprises an inserting and discharging mechanism 1 for inserting and discharging the paper money, a two-sheet detecting mechanism 2 for detecting thickness of the paper money conveyed, a discriminating part 3 for discriminating a true paper money from false one, a temporary stack 4 for temporarily winding the paper money around a tape, a reject box 5 for storing the paper money determined to be false or damaged by the discriminating part 3, a collecting box 6 for storing the left paper money when a customer leaves behind the paper money discharged by the inserting and discharging mechanism 1, recycling boxes 9, 10 for stacking the paper money and separating the stacked paper money one by one, a paper money cassette 8 for supplying and collecting the paper money, and a collecting box 7 for collecting the paper money damaged during supply.

Figure 2:
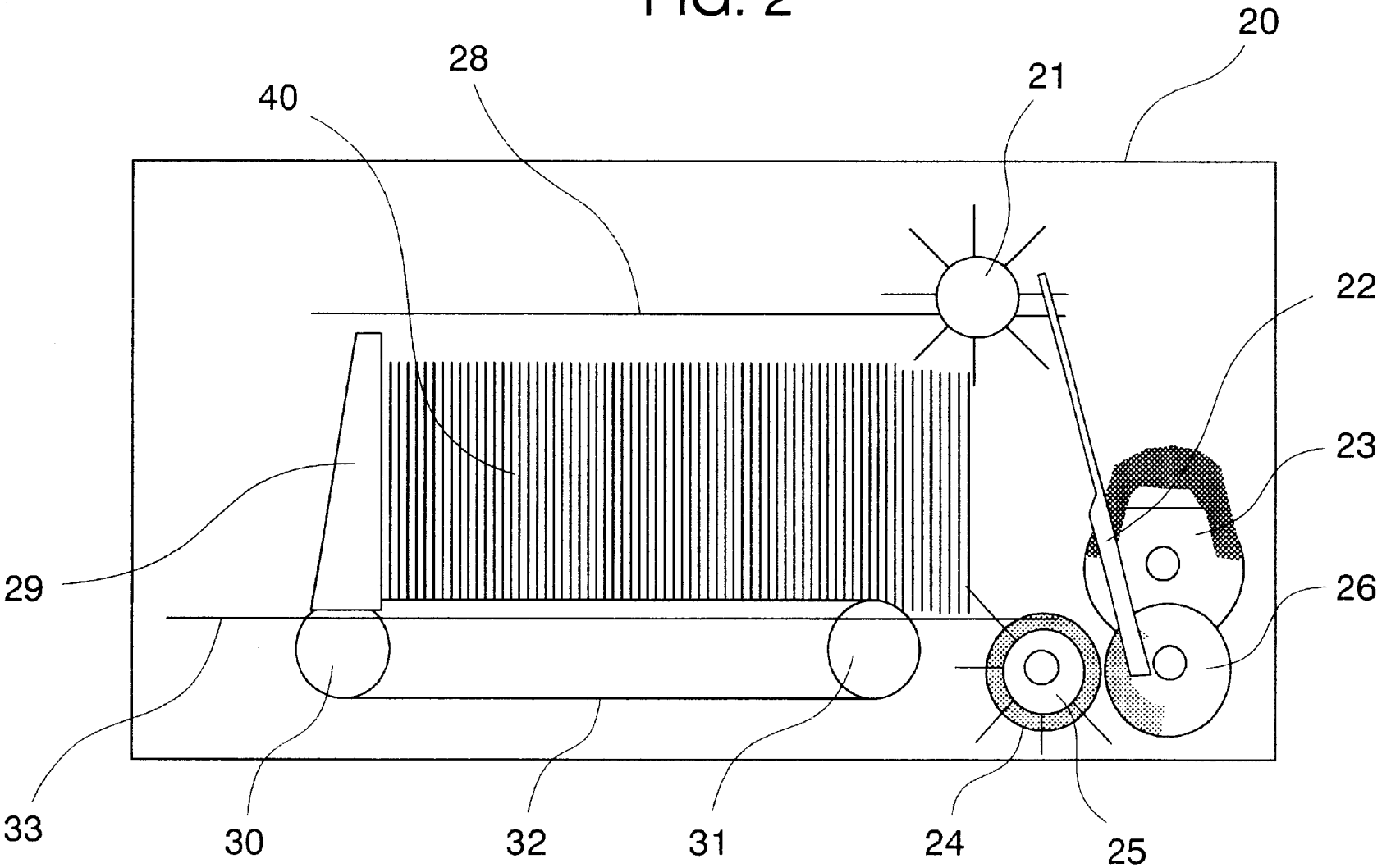
FIG. 2 is an explanatory view of a paper money recycling box according to the embodiment of the present invention.

FIG. 2 shows a recycling box 20 of the paper money handling device 11 to which the present invention is applied. It comprises a separating roller 23 partly made of a material with high friction coefficient in order to separately convey the paper money outside the box, a feed roller 26 for outplane deforming the paper money into wave-shape, a gate roller 24 for preventing more than one sheet of paper money from being conveyed, a stacking guide 22 serving as a storing guide for guiding the paper money into the box so as to be stacked, a pressing plate 29 for applying suitable pressing force on the separating roller 23, a bottom plate 33, a top plate 28, a conveying belt 32 for conveying paper moneys 40 stacked in a standing manner, gears 30, 31 for moving the belt 32 in both directions, a sheet roller 25 having an elastic sheet for pushing the paper moneys during stacking so as to be properly stacked, a sheet roller 21 having an elastic sheet for feeding the paper moneys in order to assure a stacking space for the paper moneys to be stacked.

A description will be given of a method of eliminating the charge in the stacking operation of the paper money according to an embodiment of the present invention with reference to FIGS. 3 to 6.

Figure 3:
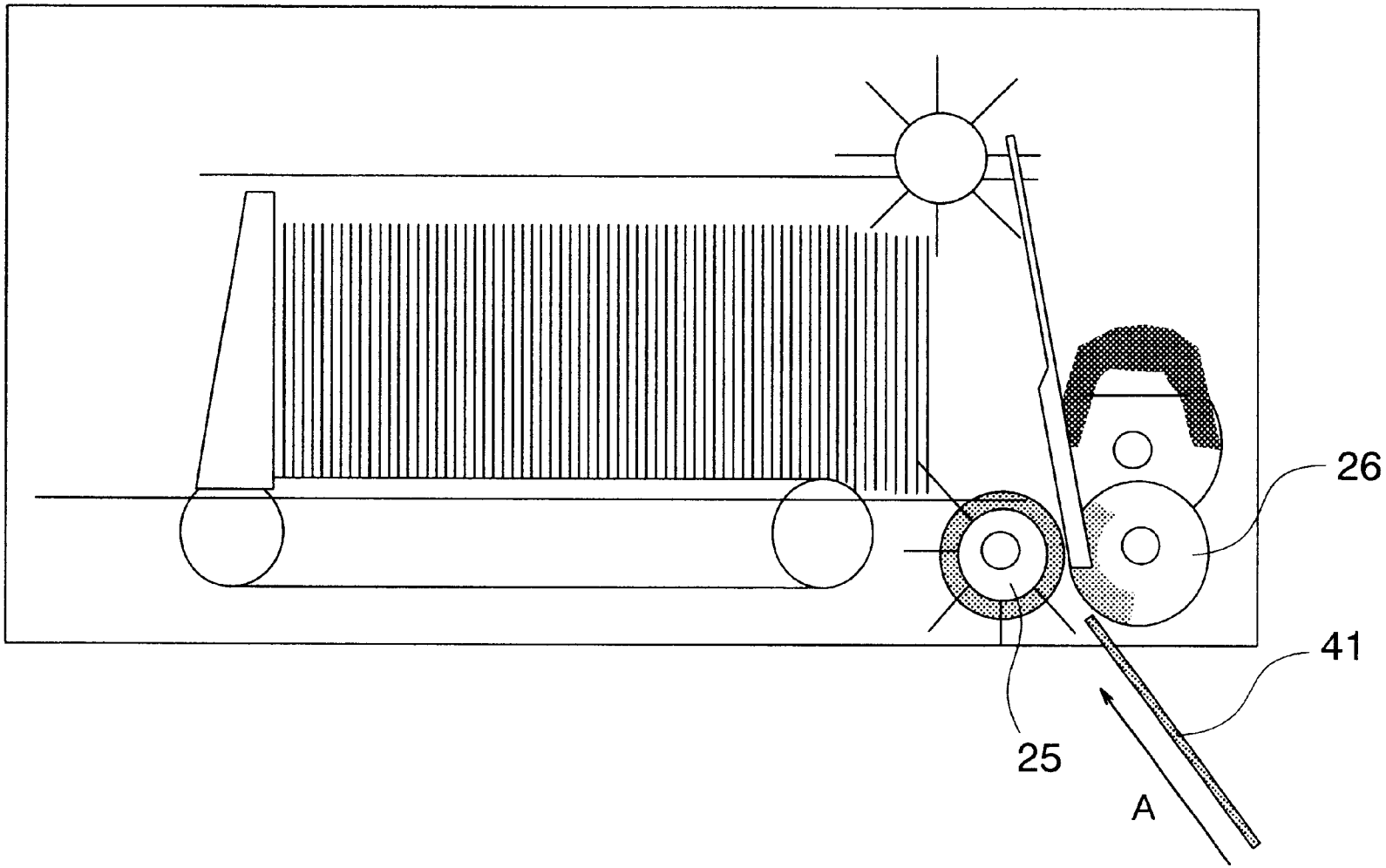
FIG. 3 is an explanatory view of the paper money recycling box according to the embodiment of the present invention.

In the stacking operation, a paper money 41 is conveyed between the feed roller 26 and the gate roller 24 in a direction of A. The sheet roller 25 keeps waiting with its elastic sheet apart from a conveying passage so as not to interrupt entering of the paper money 41 (FIG. 3).

Figure 4:
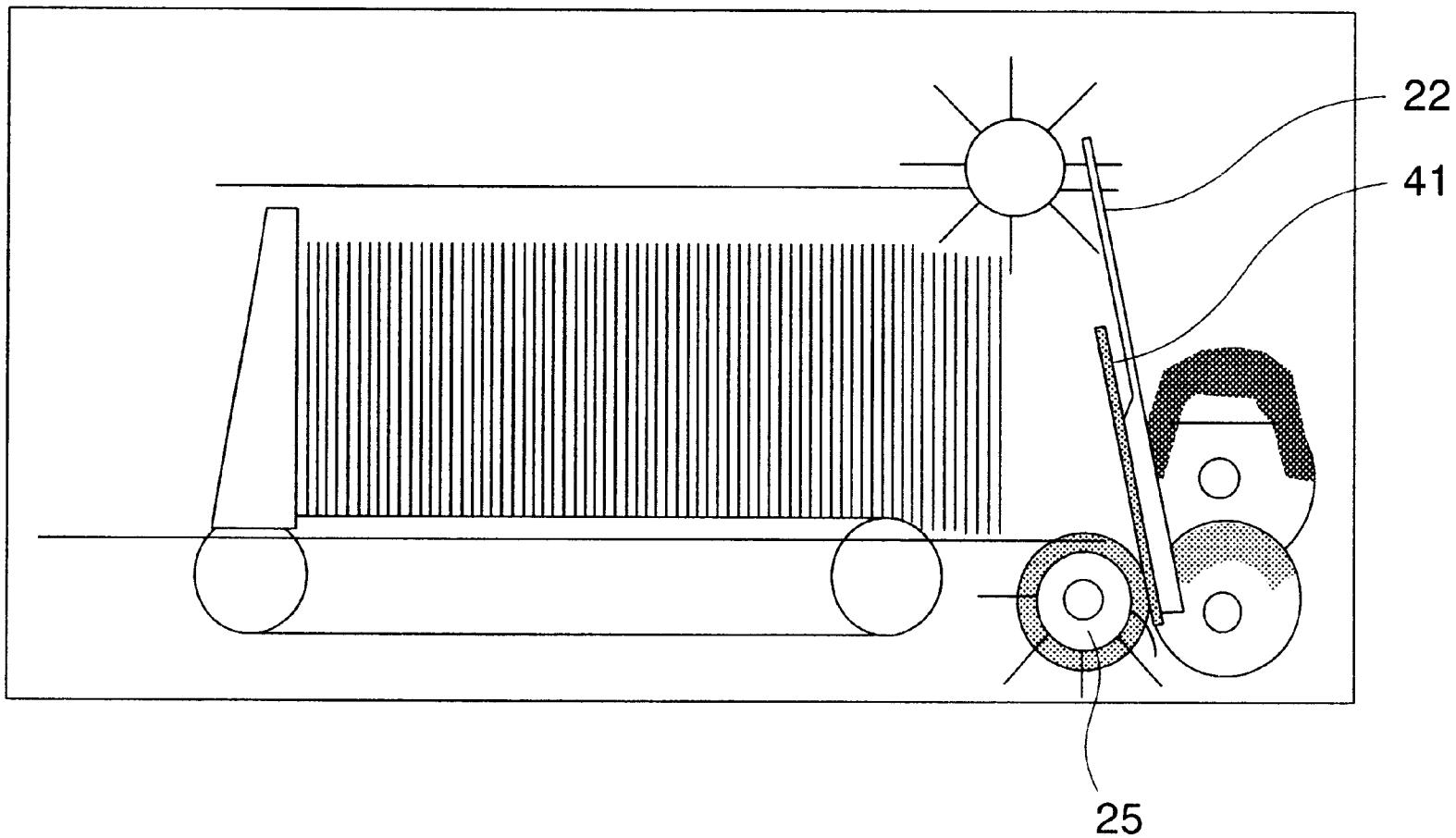
FIG. 4 is an explanatory view of the paper money recycling box according to the embodiment of the present invention.

The paper money 41 is deformed into wave-shapes by the feed roller 26 and the gate roller 24 to have higher rigidity and enters such as to be bumped against the stacking guide 22. During conveyance, the deformed paper money becomes flat by making contact with a flat part of the stacking guide 22. The flattened paper money is further conveyed and passes at a predetermined distance near a non-woven cloth for eliminating the charge in the form of a static eliminating layer (a cloth made of conductive fiber such as acrylonitrile-copper sulfide compound fiber, carbon fiber, metalized fiber, polyacetylene fiber and polypyrrole fiber). Electric discharge occurs between the charged paper money and the static eliminating layer to eliminate the charge on the paper money (FIG. 4).

The paper money is applied wave-shaped deformation to have higher rigidity and is taken in the recycling box 20 along the stacking guide 22. The paper money remaining charged is likely to be statically attached to the stacking guide 22 or other paper money after passing through the nip between the feed roller 26 and the gate roller 24. In case of eliminating the charge on the paper money remaining wave-shaped deformation by the feed roller 26 and the gate roller 24, it is difficult to eliminate the charge on a wide range of the surface of the paper money.

For this reason, in order to provide the paper money with higher rigidity for conveying and to eliminate the charge on the surface of the paper money, it is guided when conveyed along the guide in such a manner that its deformation into wave-shape is reduced at the flat part of the stacking guide 22 and that the static eliminating part properly eliminates the charge on the surface of the paper money.

Figure 5:
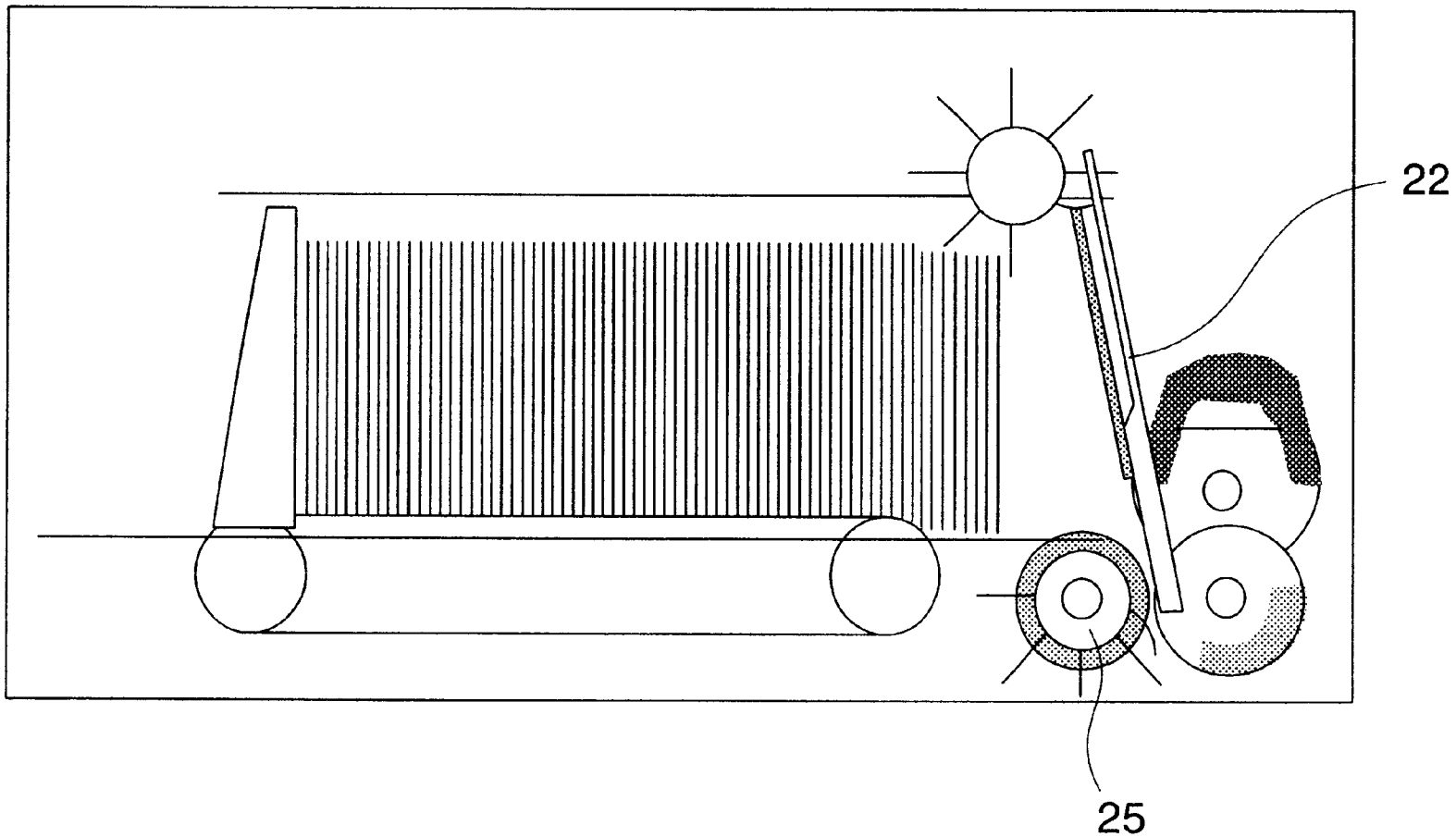
FIG. 5 is an explanatory view of the paper money recycling box according to the embodiment of the present invention.

The conveyed paper money 41 bumps against the sheet of the sheet roller 21 used for stacking and is slapped (FIG. 5).

Figure 6:
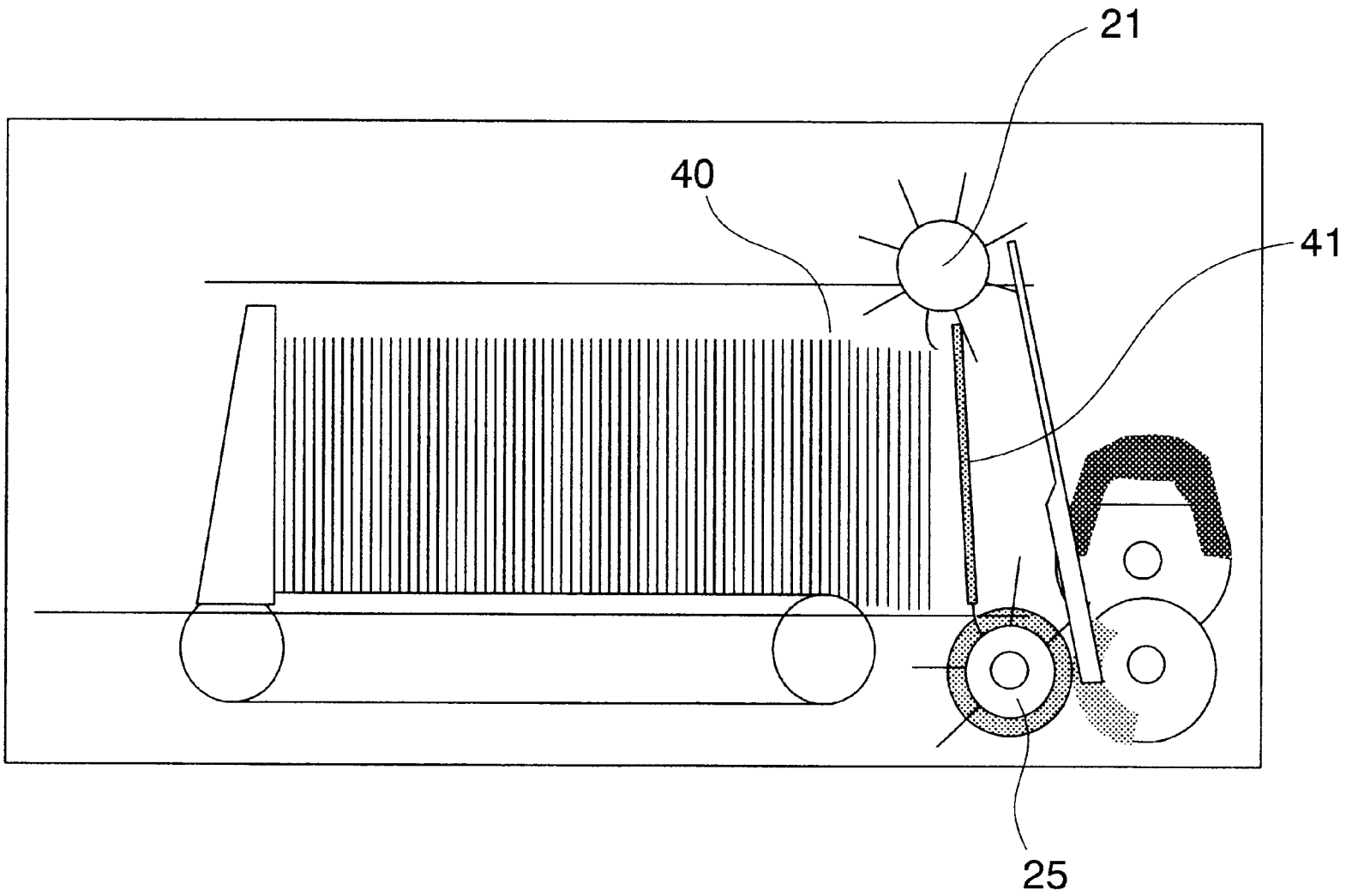
FIG. 6 is an explanatory view of the paper money recycling box according to the embodiment of the present invention.

The paper money 41 pushed by the sheet roller 21 is fed toward the paper moneys 40 which have been already stacked (FIG. 6).

Figure 7:
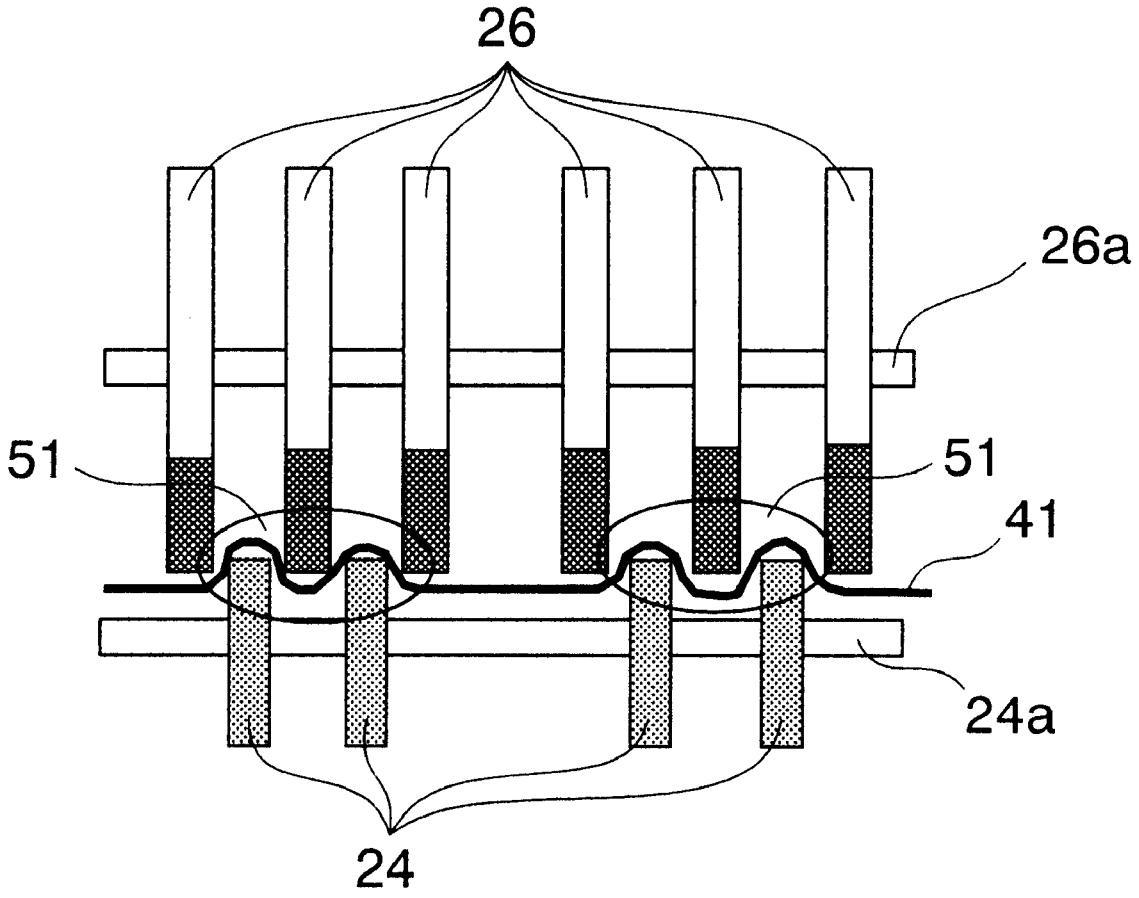
FIG. 7 is an explanatory view of deformation into wave-shape of the paper money.

FIG. 7 shows a view of the paper money 41 applied wave-shaped deformation by the feed roller 26 and the gate roller 24 taken from a downstream side in the conveying direction. As shown in this figure, the feed roller 26 and the gate roller 24 form overlapping portions 51, which deforms the paper money 41 into wave-shape with four tops. With such deformation, the paper money 41 is conveyed without being wound around the feed roller 26 or the gate roller 24.

Figure 8:
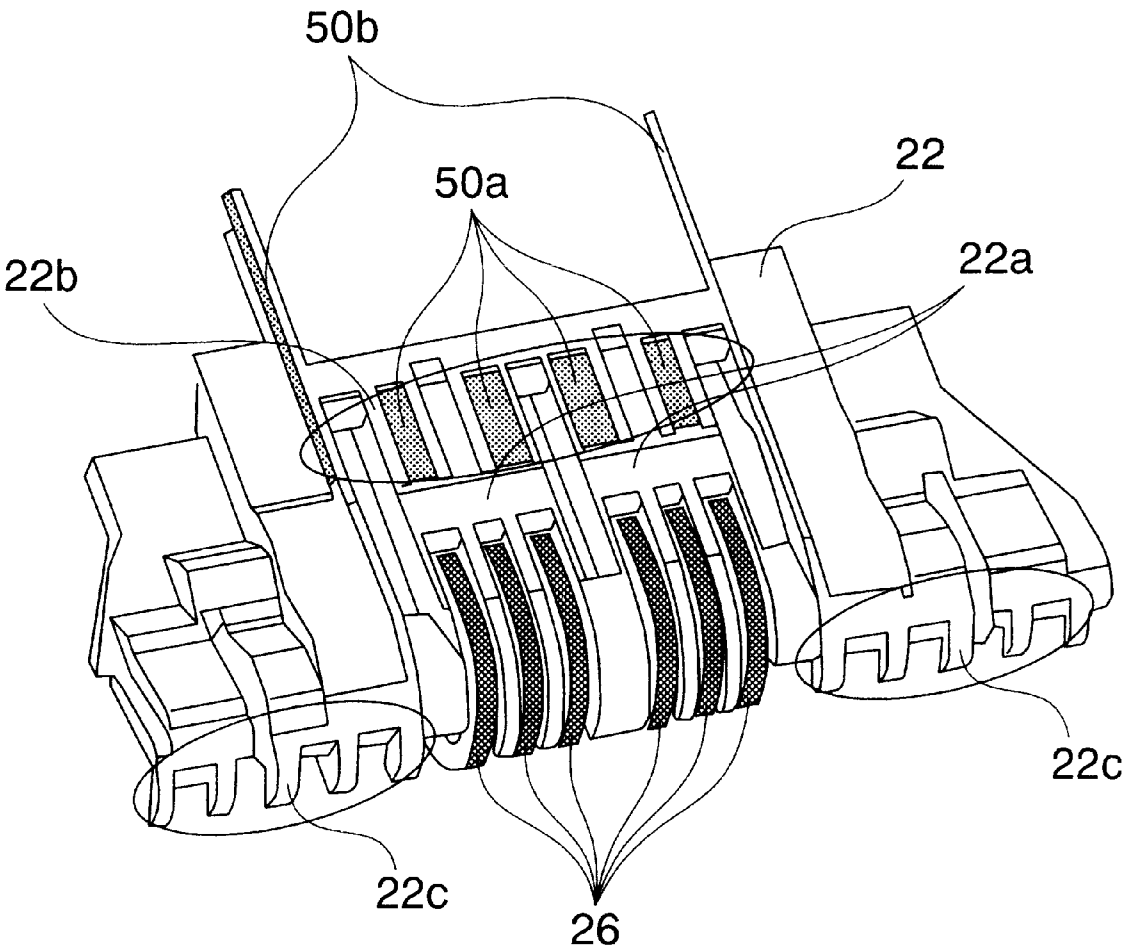
FIG. 8 is an explanatory view of a paper money stacking guide according to the embodiment of the present invention.

FIG. 8 shows a perspective view of the stacking guide 22 according to the embodiment of the present invention. The stacking guide 22 is constituted, mainly near the feed roller 26, by a guiding part 22*c* for avoiding a jam of the paper money, a flat part 22*a* which is a flat guiding part for flattening the paper money deformed into wave-shape by the feed roller 26 and then conveyed and a concavo-convex part 22*b* which is a guiding part having a concavo-convex shape in a direction perpendicular to the conveying direction. The concavity of the concavo-convex part 22*b* of the guide 22 is formed with a static eliminating layer 50*a* by the non-woven cloth or the like for eliminating the charge.

The static eliminating layer 50*a* needs to be thinner than at least a step of the concavo-convex part 22*b* of the guide 22. The static eliminating layer 50*a* is made of non-woven cloth or the like so that the friction coefficient with at least the paper money is high, which causes the jam when the paper money bumps against the static eliminating layer 50*a*.

Once the jam occurs at the guide 22, the succeeding paper money is also jammed. The jammed paper money remains in the overlapping portions 51 of the feed roller 26 and the gate roller 24. An overlapping amount (mm) of the overlapping portions 51 is maintained in at least 0.08 to 0.32 mm. The overlapping amount (mm) is increased when several sheets of paper moneys about 0.1 mm thick remain in the overlapping portions 51 in a superposed or folded manner. The jam at the guide 22 is, therefore, fatal disadvantage for assuring reliability of the device.

A suitable material for the guide 22 is such as plastic which is easy to mold and has conductivity. For example, polyphenylene carbonoid (PPO) containing carbon or acrylonitrile butadiene styrene (ABS) containing carbon is preferable.

Electric resistance of the material is preferably $10^9$ to $10^{11}$ Ω. With the material having low electric resistance, for example under $10^2$ Ω, it is difficult to obtain the effect of the static eliminating layer 50*a*.

Figure 9:
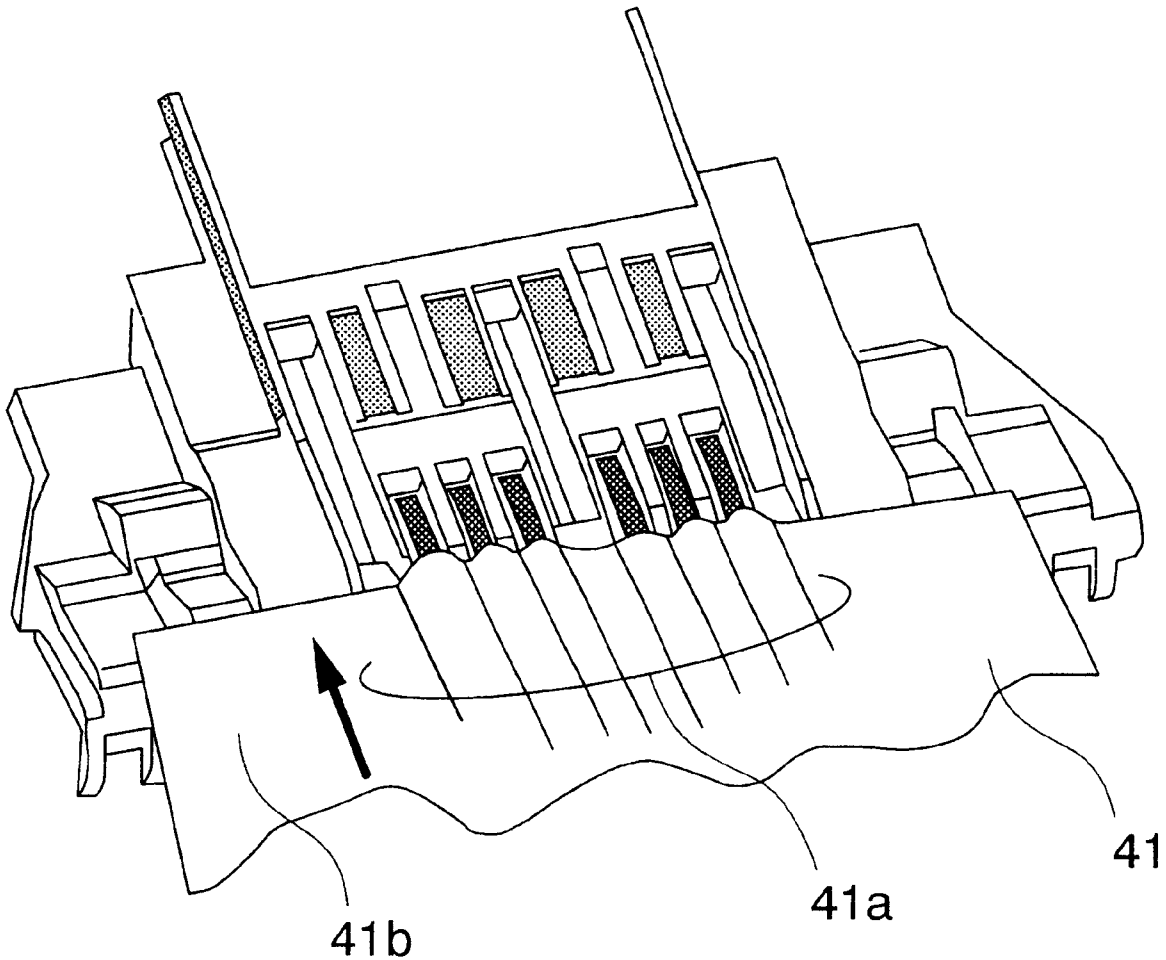
FIG. 9 is an explanatory view of the paper money stacking guide according to the embodiment of the present invention.

A description will be given of-an operation of the present invention with reference to FIGS. 9 to 11. On the conveyed paper money 41 is formed a wave-shaped deformation part 41*a* by the overlapping portions 51 and a flat part 41*b* at a part making no contact with the overlapping portions 51 (FIG. 9).

Figure 10:
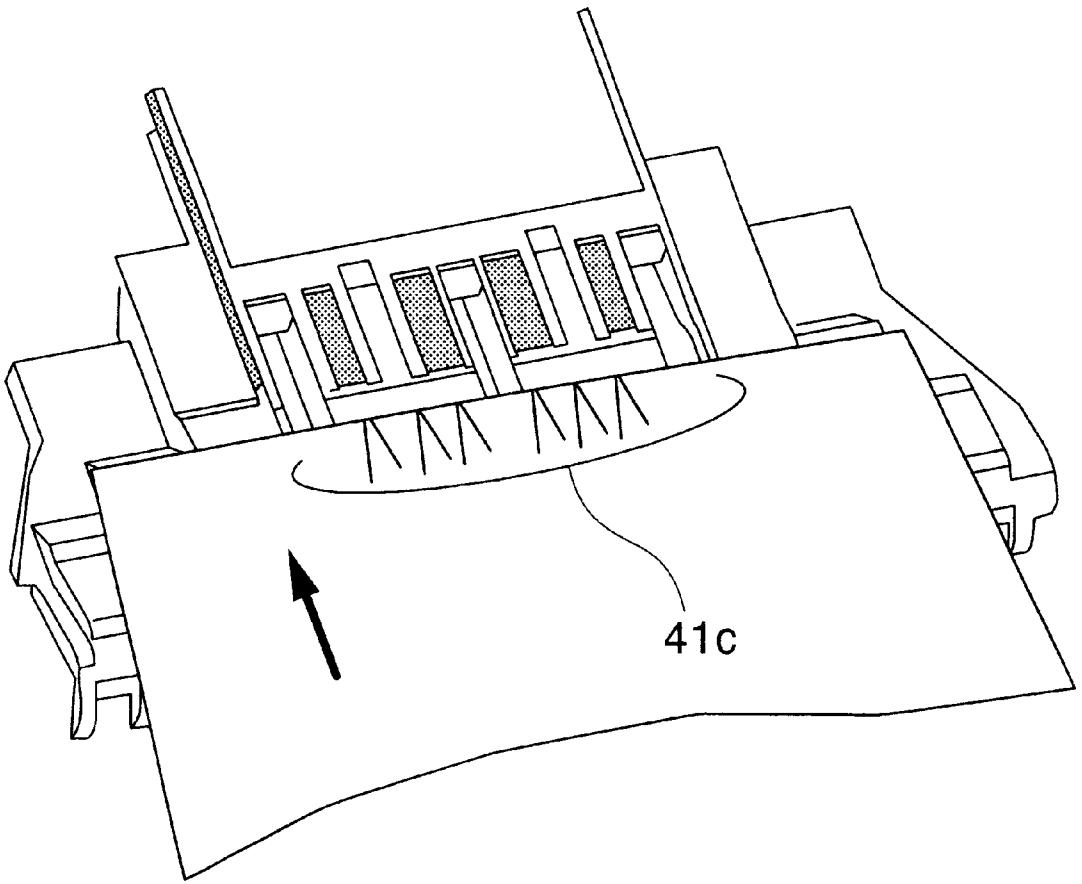
FIG. 10 is an explanatory view of the paper money stacking guide according to the embodiment of the present invention.

The paper money 41 is further conveyed and bumps against the flat part 22*a* of the guide 22 to be deformed and is formed with a flat part 41*c* having a flattened head (FIG. 10).

Figure 11:
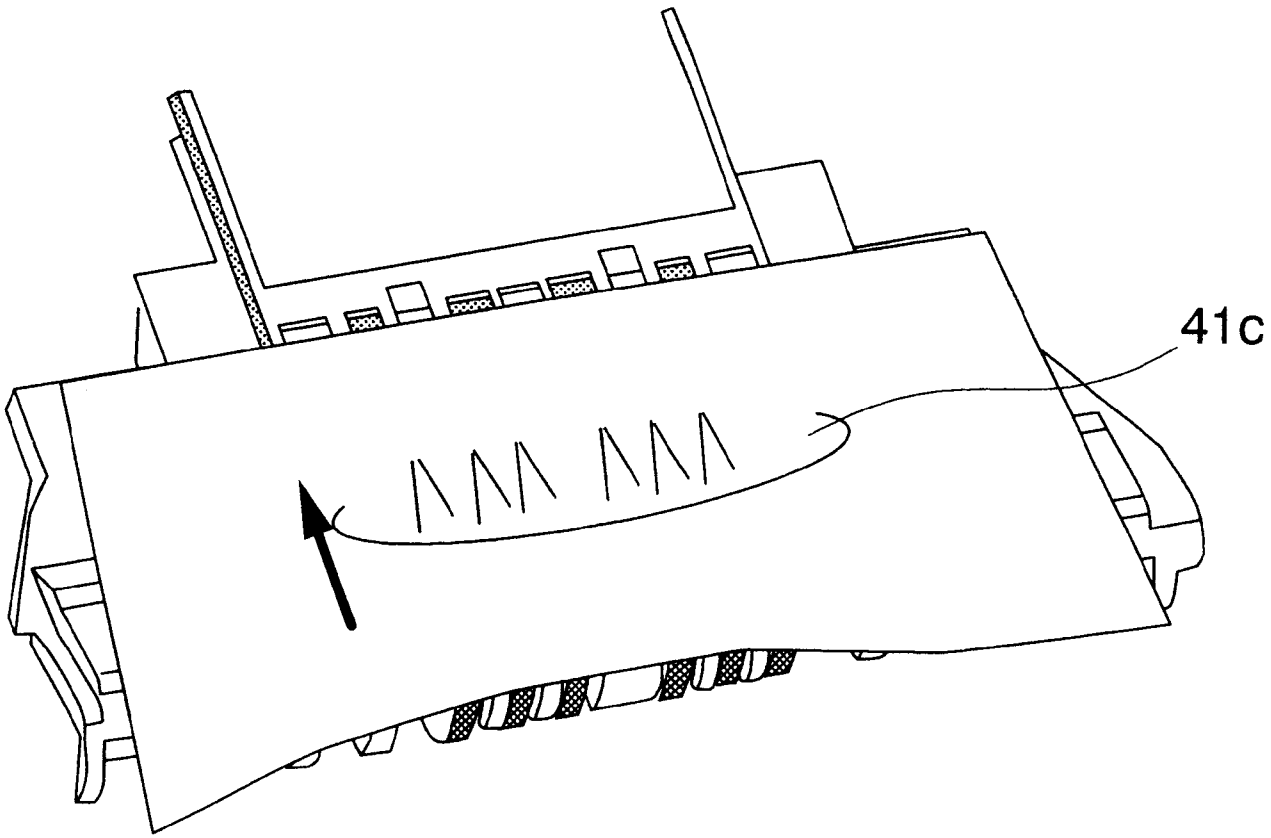
FIG. 11 is an explanatory view of a paper money stacking guide according to the embodiment of the present invention.

When the paper money 41 is still further conveyed, the flat part 41*c* of the paper money 41 is moved to an upstream side of the paper money 41 in the conveying direction A (FIG. 11). The paper money has the charge on its surface discharged with a proper distance maintained from the static eliminating layer 50*a* by the guiding part 22*a* of the stacking guide 22.

The prior art disclosed in Japanese Unexamined Patent Publication No. 11-180611 in which the paper money is conveyed by a guide comprising a rib for guiding the paper money in the conveying direction and a static eliminating layer in order to avoid charging of the paper money has no reference to the jam between the static eliminating layer and the paper in the case where the paper is conveyed with outplane deformed.

This is because the prior art disclosed in Japanese Unexamined Patent Publication No. 11-180611 relates to an image forming apparatus where charge on a flat paper money is to be eliminated.

As described above, according to the embodiment of the present invention, the paper money is conveyed with outplane deformed into wave-shape to have higher rigidity when it is not only flat but has wrinkles, folds or breaks. In order to avoid the jam between the deformed paper money and the static eliminating part, the paper money is once bumped against the flat guide to be flat and conveyed near the static eliminating layer, which permits avoiding the jam and eliminating the charge.

According to the present invention, it is possible to avoid the jam of the charged paper money by outplane deforming the same into wave-shaped and also to avoid charging of the paper money.

What is claimed is:

1. A paper money handling device comprising:

a paper money storing box for storing a conveyed paper money in the paper money handling device, wherein said paper money storing box is provided with a storing mechanism for storing the paper money inside, and a storing guide provided on the storing mechanism is formed by at least a flat part and a concavo-convex part, and a concave portion thereof includes a static eliminating part, and wherein said static eliminating part is thinner than a step of the concavo convex part of said storing guide.

2. The paper money handling device according to claim 1, wherein the flat part of said storing guide is formed upstream of the concavo-convex part in a conveying direction of the conveyed paper money at the time of storing of the paper money.

3. A paper money handling device comprising:

a paper money storing box for storing a conveyed paper money in the paper money handling device, wherein said paper money storing box is provided with a storing mechanism for storing the paper money inside, and a storing guide provided on the storing mechanism is formed by at least a flat part and a concavo-convex part, and a concave portion thereof includes a static eliminating part, and wherein a surface of said static eliminating part is lower than a convex portion of the concavo-convex part provided on said storing guide.

4. The paper money handling device according to claim 1, wherein said static eliminating part is made of non-woven cloth.

5. A paper money handling device comprising: a paper money storing box for storing a conveyed paper money in the paper money handling device, wherein said paper money storing box is provided with a storing mechanism for storing the paper money inside, and a storing guide provided on the storing mechanism is formed by at least a flat part and a static eliminating part, and wherein said storing box is further provided with the storing guide which comprises: a roller for conveying the conveyed paper money in the paper money handling device and deforming said paper money into wave-shape; the flat part for flattening said paper money deformed into wave-shape; and the static eliminating part provided downstream of said flat part in a moving direction at the time of storing the paper money.

6. The paper money handling device according to claim 3, wherein the flat part of said storing guide is formed upstream of the concavo-convex part in a conveying direction of the conveyed paper money at the time of storing of the paper money.

7. The paper money handling device according to claim 3, wherein said static eliminating part is made of non-woven cloth.

* * * * *